US008011962B2

(12) United States Patent
Pizzi

(10) Patent No.: US 8,011,962 B2
(45) Date of Patent: Sep. 6, 2011

(54) CLAMPING PART WITH CONDUCTING BODY IN THE FORM OF AN OVERTURNED L FOR CONNECTING ELECTRIC WIRES

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 12/171,384

(22) Filed: Jul. 11, 2008

(65) Prior Publication Data

US 2009/0017702 A1 Jan. 15, 2009

(30) Foreign Application Priority Data

Jul. 12, 2007 (IT) ..... MI2007A1390

(51) Int. Cl.
*H01R 9/03* (2006.01)

(52) U.S. Cl. ..... 439/610

(58) Field of Classification Search ..... 439/610, 439/811, 812, 801, 797
See application file for complete search history.

(56) References Cited

U.S. PATENT DOCUMENTS

| | | | | |
|---|---|---|---|---|
| 945,017 | A | 1/1910 | Cole | |
| 2,045,847 | A * | 6/1936 | Fotsch | 439/793 |
| 2,082,947 | A * | 6/1937 | Fotsch | 439/811 |
| 2,900,618 | A * | 8/1959 | Geier | 439/812 |
| 3,159,730 | A | 12/1964 | Staffel | |
| 3,609,642 | A | 9/1971 | Norden | |
| 3,665,376 | A | 5/1972 | Paris et al. | |
| 3,751,579 | A | 8/1973 | Nojiri | |
| 3,775,733 | A | 11/1973 | Ege | |
| 3,840,781 | A | 10/1974 | Brown | |
| 4,070,086 | A * | 1/1978 | Trafford | 439/717 |
| 4,130,331 | A | 12/1978 | Neff et al. | |
| 4,171,861 | A | 10/1979 | Hohorst | |
| 4,203,200 | A | 5/1980 | Wiebe | |
| 4,224,592 | A | 9/1980 | Urani et al. | |
| 4,241,975 | A | 12/1980 | Cooper, Jr. | |
| 4,330,164 | A | 5/1982 | Pittman et al. | |
| 4,340,270 | A | 7/1982 | Wilmes et al. | |
| 4,350,407 | A | 9/1982 | Tong | |
| 4,365,396 | A | 12/1982 | Baba et al. | |
| 4,391,485 | A | 7/1983 | Urani | |

(Continued)

FOREIGN PATENT DOCUMENTS

DE 1842868 U 12/1961

(Continued)

OTHER PUBLICATIONS

European Search Report from EP08075059, dated, Aug. 24, 2009.

*Primary Examiner* — Phuong K Dinh
(74) *Attorney, Agent, or Firm* — Mintz, Levin, Cohn, Ferris, Glovsky and Popeo, P.C.

(57) ABSTRACT

A wire clamp for connecting electric wires includes a conducting body having a horizontal portion and a vertical portion in the form of an overturned L. The vertical portion includes an opening adapted to receive the bare end of a wire for clamping and the horizontal portion includes an engagement element adapted to engage an actuating element, such as a screw, for actuating the conducting body in the vertical direction to clamp the wire against a horizontal element. The horizontal portion can include a free end that is folded downward, extending in a vertical direction. The folded free end can interfere with the actuating element causing the actuating element to lock.

9 Claims, 2 Drawing Sheets

U.S. PATENT DOCUMENTS

| | | | | |
|---|---|---|---|---|
| 4,444,455 | A | 4/1984 | Wiancko et al. | |
| 4,559,504 | A | 12/1985 | Krec | |
| 4,693,533 | A | 9/1987 | Szczesny et al. | |
| 4,795,997 | A | 1/1989 | Fisher et al. | |
| 4,889,504 | A | 12/1989 | Barbier et al. | |
| 4,921,450 | A | 5/1990 | Herbert | |
| 4,940,431 | A | 7/1990 | Hennemann | |
| 5,002,505 | A | 3/1991 | Jones et al. | |
| 5,030,131 | A * | 7/1991 | Boehm | 439/387 |
| 5,243,139 | A | 9/1993 | Law | |
| 5,276,280 | A | 1/1994 | Ball | |
| 5,328,392 | A | 7/1994 | Lin et al. | |
| 5,454,730 | A | 10/1995 | Tozuka | |
| 5,553,787 | A | 9/1996 | Guginsky | |
| 5,564,941 | A | 10/1996 | Norden | |
| 5,766,044 | A | 6/1998 | Norden | |
| 5,853,304 | A | 12/1998 | Landreau et al. | |
| 5,860,837 | A | 1/1999 | Bock et al. | |
| 5,905,230 | A | 5/1999 | Marik | |
| 5,915,998 | A | 6/1999 | Stidham et al. | |
| 6,004,167 | A | 12/1999 | Hirakawa | |
| 6,157,287 | A | 12/2000 | Douglass et al. | |
| 6,475,038 | B1 | 11/2002 | Franck | |
| 6,786,779 | B2 | 9/2004 | Feldmeier et al. | |
| 7,101,231 | B2 | 9/2006 | Prokup et al. | |
| 7,385,518 | B2 | 6/2008 | Torrez et al. | |
| 7,413,486 | B2 | 8/2008 | Pizzi | |
| 7,438,606 | B2 | 10/2008 | Pizzi | |
| 7,473,146 | B2 * | 1/2009 | Fuzetti et al. | 439/798 |
| 7,500,889 | B2 | 3/2009 | Pizzi | |
| 2002/0067279 | A1 | 6/2002 | Torrez et al. | |
| 2005/0042912 | A1 | 2/2005 | Drewes et al. | |
| 2005/0221665 | A1 | 10/2005 | Otto et al. | |
| 2006/0128232 | A1 | 6/2006 | Kim | |
| 2006/0148302 | A1 | 7/2006 | Patel et al. | |
| 2006/0189222 | A1 | 8/2006 | Bogiel et al. | |
| 2006/0228950 | A1 | 10/2006 | Jamaleddin et al. | |
| 2007/0159292 | A1 | 7/2007 | Chang et al. | |
| 2008/0242150 | A1 | 10/2008 | Chikamatsu et al. | |

FOREIGN PATENT DOCUMENTS

| | | | |
|---|---|---|---|
| DE | 2914192 | A1 | 10/1980 |
| DE | 3339365 | A1 | 5/1985 |
| DE | 3621071 | A1 | 1/1987 |
| DE | 3629796 | C1 | 12/1987 |
| DE | 3805158 | A1 | 8/1989 |
| DE | 4223540 | A1 | 1/1994 |
| DE | 4231244 | A1 | 3/1994 |
| DE | 4409612 | A1 | 9/1994 |
| DE | 19530947 | A1 | 1/1997 |
| DE | 19542628 | C1 | 2/1997 |
| DE | 19729327 | C1 | 10/1998 |
| DE | 29821558 | U1 | 3/1999 |
| DE | 29921080 | | 4/2001 |
| DE | 10010719 | C1 | 8/2001 |
| DE | 20303475 | U1 | 5/2003 |
| DE | 10324144 | A1 | 2/2005 |
| DE | 102004018553 | A1 | 11/2005 |
| DE | 202005005369 | U1 | 3/2006 |
| DE | 102008009986 | A1 | 7/2009 |
| EP | 0382999 | | 8/1990 |
| EP | 0678934 | A1 | 10/1995 |
| EP | 0893859 | A2 | 1/1999 |
| EP | 1137034 | A1 | 9/2001 |
| EP | 1137035 | A1 | 9/2001 |
| EP | 1381068 | A1 | 1/2004 |
| EP | 1531522 | A1 | 5/2005 |
| EP | 1536519 | A1 | 6/2005 |
| EP | 1630903 | A1 | 3/2006 |
| EP | 1798821 | A2 | 6/2007 |
| EP | 1860738 | A1 | 11/2007 |
| EP | 1887658 | A2 | 2/2008 |
| FR | 1593558 | A | 6/1970 |
| FR | 2259462 | A1 | 8/1975 |
| FR | 2529024 | A1 | 12/1983 |
| FR | 2637740 | A1 | 4/1990 |
| FR | 2766628 | A1 | 1/1999 |
| GB | 2342508 | A | 4/2000 |

* cited by examiner

CLAMPING PART WITH CONDUCTING BODY IN THE FORM OF AN OVERTURNED L FOR CONNECTING ELECTRIC WIRES

BACKGROUND

1. Technical Field of the Invention

The present invention relates to a clamping part for connecting electric wires, comprising a conducting body substantially in the form of an overturned L.

2. Description of the Prior Art

It is known in the technical sector relating to electrical connection devices such as terminal strips, connection boxes and the like to use terminals able to be mounted on associated supports and to provide frontal access to the means—normally of the screw type—for retaining the electrical connection wires which form the electric circuit.

It is also known that said means for retaining the end of the electric wire are normally formed using so-called sliders which are movable in a direction perpendicular to that in which the wire is inserted, upon operation of a screw which recalls the slider which grips the wire between the slider and a counter-plate extending parallel to the wire and able to ensure electrical continuity of the circuit inside the device.

Known alternatives to these sliders moved by a screw include wire clamping parts formed by a resilient plate which is deformed by means of compression in order to allow opening of a slit and insertion of the wire into its seat; once insertion has been completed, the plate is released and, returning resiliently into the rest position, ensures clamping of the wire against the counter-plate and electrical connection.

SUMMARY

Although fulfilling their function, these known clamping means nevertheless have drawbacks which in the case of the screw-type slider are essentially due to the following: the presence of the screw itself which tends to come loose with time, not guaranteeing the necessary clamping of the wire and the fact that the latter is clamped between two flat surfaces whose complex forms are difficult to produce, resulting in an irregular flatness which does not ensure full electric contact between the wire and terminal.

In the case of the spring, on the other hand, the drawback arises from the resilient force which must be imparted to the plate in order to ensure adequate clamping of the wire, said resilient force, which increases with an increase in the electric loads, making the wire insertion operation difficult.

The technical problem which is posed, therefore, is to provide a clamping part for electric wires, in particular for use inside connection devices such as terminal strips, connection boxes, distribution switchboards for wired circuits and the like, which has compact overall dimensions, but which at the same time is able to support a high electric load and combines the ease of a screw-type clamping system with the advantages of irreversible clamping achieved with a resilient plate.

In connection with this problem it is also required that this clamping part should be easy and inexpensive to produce, should be able to be used equally well with any of the various types of electrical connection devices and should be able to be easily operated by any user using normal standard tools.

These results are achieved according to the present invention by a clamping part for connecting electric wires, comprising a conducting body where said conducting body has the form of an overturned L.

BRIEF DESCRIPTION OF THE FIGURES

Further details may be obtained from the following description of a non-limiting example of embodiment of the subject of the present invention provided with reference to the accompanying drawings in which.

DETAILED DESCRIPTION OF PREFERRED EMBODIMENTS

Figure 1:
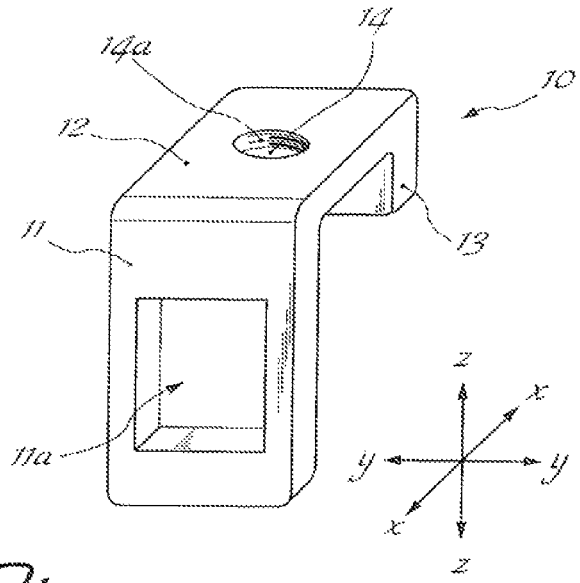
FIG. 1 shows a perspective view of a first embodiment of the clamping part for electric wires according to the present invention.

As shown in FIG. 1 and assuming for the sole sake of convenience of the description and without a limiting meaning a set of three reference axes, in a longitudinal direction X-X, transverse direction Y-Y and vertical direction Z-Z, respectively, the clamping part 10 according to the present invention comprises a conducting body substantially in the form of an overturned L, with a vertical face 11 having a length greater than the longitudinal horizontal face 12; the latter has a free end 13 folded downwards in a substantially vertical direction Z-Z.

The vertical face 11 has an opening 11*a* able to allow entry, in the longitudinal direction X-X, of the end 1*a* of the wire 1 (FIG. 2), while a hole 14 with a female thread 14*a* suitable for engagement with a corresponding thread 2*a* of an actuating screw 2 is formed in the horizontal face 12.

Figure 3:
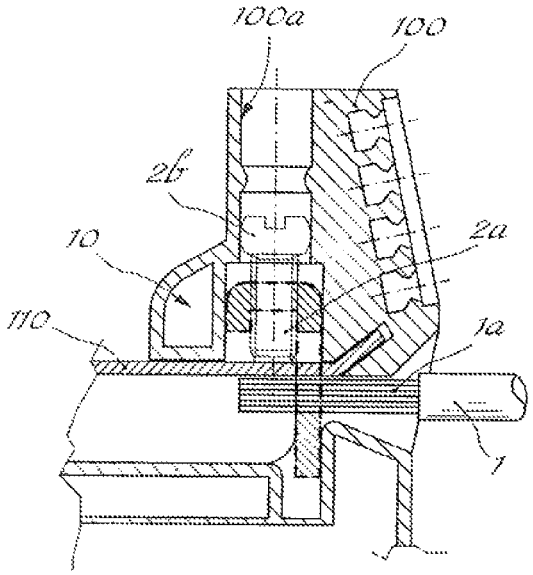
FIG. 3 shows a schematic cross-sectional view, along a vertical plane, of a first mode of application of the clamping part according to the present invention.
Figure 4:
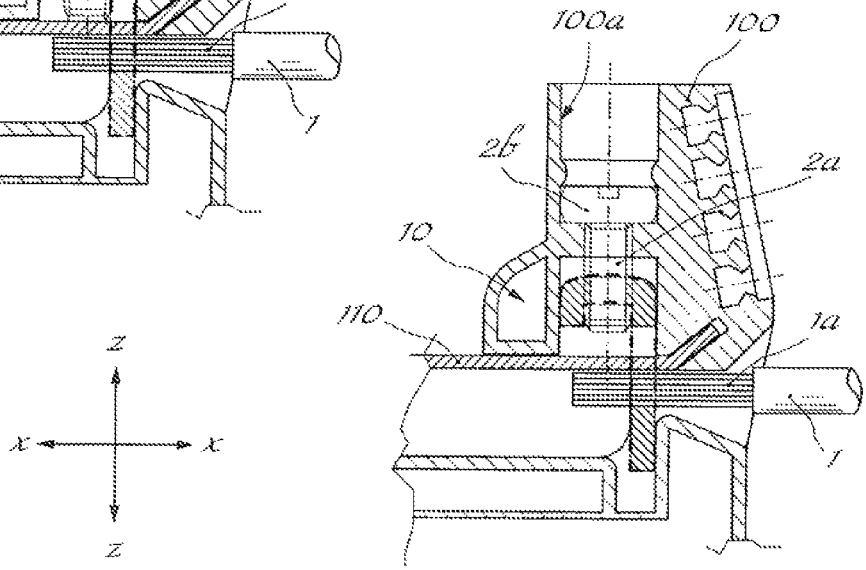
FIG. 4 shows a schematic cross-sectional view, along a vertical plane, of a mode of application of the clamping part according to the present invention.

As shown in FIG. 3, it is envisaged that the clamping part 10 may be inserted inside a switchboard terminal block 100, inside which it operates with a screw 2 which acts with its shank 2*a* on the counter-plate 110 extending in the longitudinal direction X-X, or, as shown in FIG. 4, with a screw 2 which operates with its head 2*b* on the base of the corresponding seat 100*a*; in both cases, tightening the screw in the vertical direction Z-Z and clamping the part 10 onto the wire 1*a* causes deformation of the former (indicated by broken lines) with generation of a twisting moment which, being transmitted to the screw 2, causes jamming thereof, preventing it from being slackened and from moving outwards.

Figure 5:
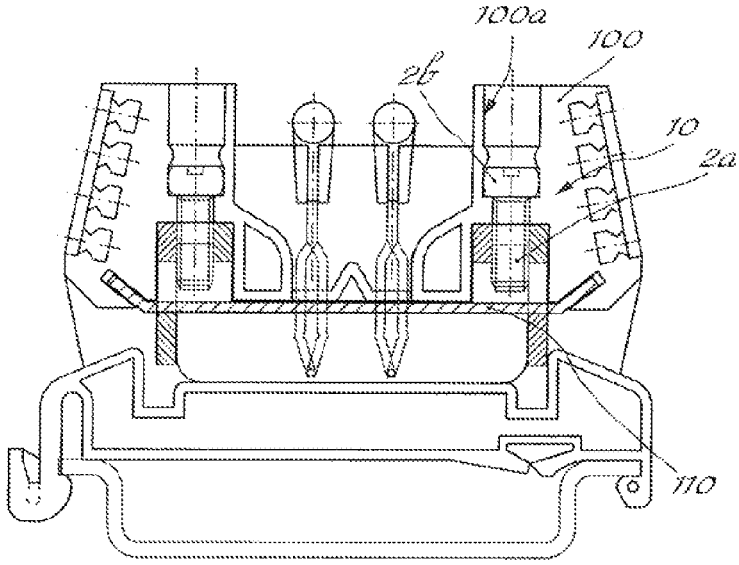
FIG. 5 shows a schematic cross-sectional view, along a vertical longitudinal plane, of a terminal block for switchboards with a clamping part according to the present invention.
Figure 6:
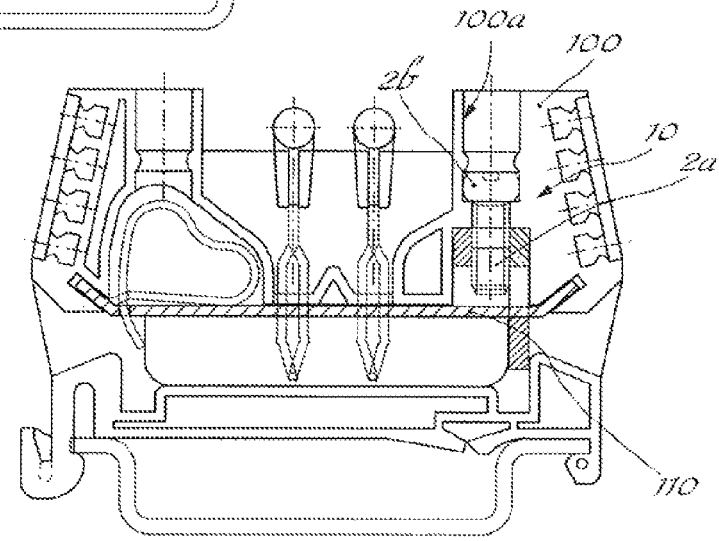
FIG. 6 shows a cross-sectional view, similar to that of FIG. 5, of a further application of the clamping part according to the present invention.

FIGS. 5 and 6 show further modes of application of the clamping part 10 according to the present invention, from which it can be seen that, owing to the smaller dimensions of the clamping part, the latter may be applied as an alternative to a resilient plate, also inside the same terminal block 100; in addition it is pointed out how, unlike the known art, with the clamping part according to the present invention it is possible to design the counter-plate 110 with one form which is always the same in all applications with obvious advantages in terms of simplified production and easier management of warehouse stocks.

Figure 2:
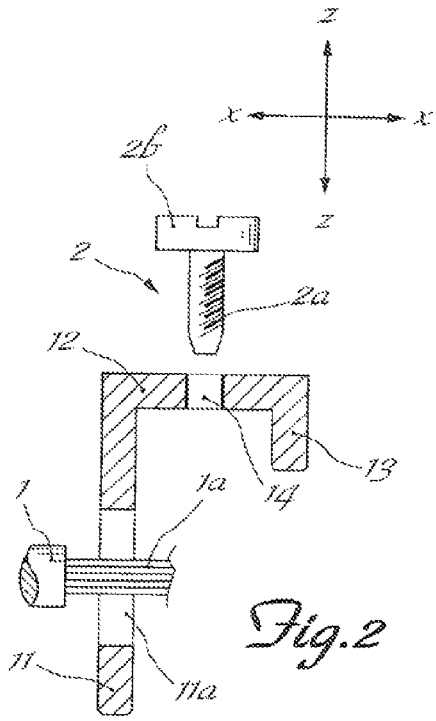
FIG. 2 shows a schematic cross-sectional view, along a vertical longitudinal plane, of the clamping part according to FIG. 1.
Figure 7:
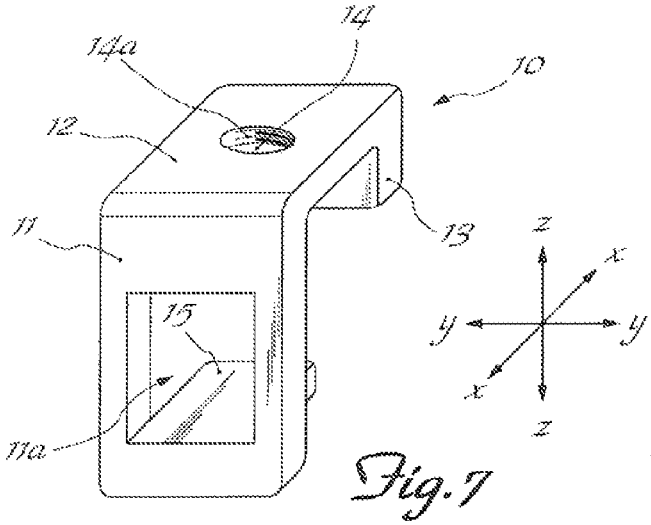
FIG. 7 shows a perspective view of a second embodiment of the clamping part for electric wires according to the present invention.
Figure 8:
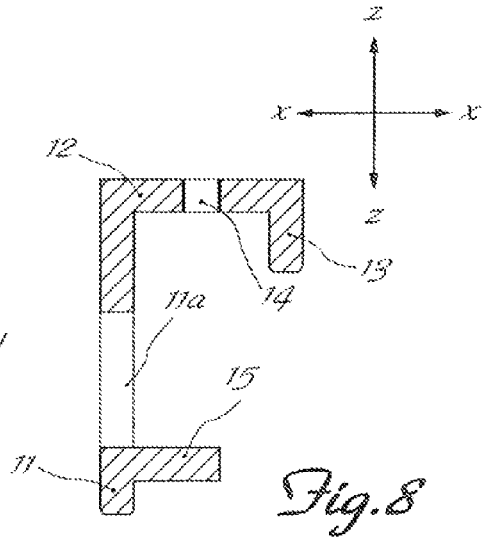
FIG. 8 shows a schematic cross-sectional view, along a vertical longitudinal plane, of the clamping part according to FIG. 7.

Finally, FIGS. 7 and 8 show a second embodiment of the clamping part according to the present invention which is provided by forming the opening of the hole 11*a* in the vertical face 11 by means of inwards folding of the tongue 15 which is not cut as in the case of FIGS. 1 and 2, but remains integral with the body 10 and assists clamping of the wire 1*a*.

It is therefore clear how with the clamping part according to the present invention it is possible to achieve much simpler and faster large-scale production, with a simultaneous saving of material used and a reduction in the overall dimensions, while ensuring at the same time ease of operation by means of a screw and secure clamping by means of a resilient plate, also owing to the fact that the clamping action and electric contact are achieved over a smaller section of the vertical face which is perpendicular to the longitudinal direction X-X of the wire 1*a*, unlike that which occurs in the known art where the contact is obtained over a broad surface area which is not very efficient owing to the smaller specific clamping force.

In addition, it can be seen how the female thread of the clamping part which co-operates with the actuating screw is formed in the thickness of a single face instead of a double face as in the known art, with a consequent reduction in the amount of material, but without weakening the structure.

The invention claimed is:

1. A wire clamp for connecting electric wires within a housing, the clamp comprising:

a counter plate fixed in relation to the housing and extending in a horizontal direction, an L-shaped conducting body in the form of an overturned L having a horizontal face, wherein the horizontal face includes a free end folded downwards in a substantially vertical direction to form a vertical face, the L-shaped conducting body being configured such that as the horizontal face is actuated away from the counter plate, the electric wire is clamped against the counter plate by the vertical face, and an actuating element engaging the conducting body at the horizontal face and configured to pull the conducting body in a vertical direction relative to the housing, substantially transverse to the counter plate, wherein the horizontal face extends from the vertical face longitudinally along the horizontal extending direction of the counter plate.

2. A clamp according to claim 1, wherein the vertical face extends in the vertical direction having a vertical length and horizontal face extends in the horizontal direction having a horizontal length, wherein the vertical length of the vertical face is greater than the horizontal length of the horizontal face.

3. A clamp according to claim 1, wherein the vertical face of the conducting body has an opening and a portion of the counter plate extends through said opening, and wherein an electric wire inserted in to said opening can be pressed against the counter plate by actuating the actuating element and pulling the conducting body in a vertical direction substantially transverse to the counter plate.

4. A clamp according to claim 1, wherein the horizontal face of the conducting body includes a hole extending along a vertical axis having a female thread and the actuating element includes a screw having a threaded shank, the thread corresponding to the female thread of the hole in the horizontal face.

5. A clamp according to claim 2, wherein the horizontal face has a single thickness.

6. A clamp according to claim 1, wherein the vertical face of the conducting body is perpendicular to the longitudinal direction of insertion of the wire, and the vertical face has an opening adapted for insertion of an end of a wire in the longitudinal direction and a tongue extending in the longitudinal direction from the opening for contacting the wire and pressing the wire against the counter plate.

7. A claim according to claim 1, wherein actuating the actuating element to pull the conducting body in a vertical direction causes the conducting body to deform and bear on the actuating element inhibiting motion of the actuating element.

8. A clamp according to claim 4, wherein actuating the screw causes the screw to pull the conducting body in a vertical direction whereby the conducting body presses a wire against the counter plate causing the conducting body to deform and bear on the screw inhibiting further motion of the screw which could release the wire.

9. A switchboard terminal block comprising:

a counter-plate arranged parallel to a longitudinal axis of the terminal block;

a screw;

a clamping element in the form of an overturned L, having a vertical face with a length greater than a longitudinal horizontal face, the vertical face forming an opening able to receive the end of a wire, the horizontal face forming an orifice configured to engage the screw, wherein said longitudinal horizontal face has a free end folded downwards in a substantially vertical direction and the vertical face is orthogonal to the longitudinal axis of the counter plate, such that the wire is inserted along the longitudinal axis and parallel to the counter-plate; and a body defining an inside space configured to house the counter plate and the clamping element, the body defining a hole configured to connect the inside space with the outside for the insertion of the end of the wire into the switchboard terminal block, the body further defining a hole for the insertion and maneuvering of the screw acting on the clamping element.

* * * * *